US005438783A

United States Patent [19]

Sniezak et al.

[11] Patent Number: 5,438,783

[45] Date of Patent: Aug. 8, 1995

[54] BUTT PLATE ASSEMBLY FOR HANDGUN MAGAZINES

[75] Inventors: Gary A. Sniezak, Windsor, Conn.; Robert C. Dionne, Ludlow, Mass.

[73] Assignee: Smith & Wesson Corp., Springfield, Mass.

[21] Appl. No.: 207,350

[22] Filed: Mar. 7, 1994

[51] Int. Cl.[6] ..... F41A 9/24

[52] U.S. Cl. ..... 42/7; 42/50

[58] Field of Search ..... 42/50, 18, 22, 7; 89/195, 196, 197

[56] References Cited

U.S. PATENT DOCUMENTS

| | | | |
|---|---|---|---|
| 2,265,170 | 12/1941 | Humeston | 42/50 |
| 3,377,732 | 4/1968 | Bivens | 42/50 |
| 4,343,107 | 8/1982 | Kaltenegger | 42/7 |
| 4,495,720 | 1/1985 | Bross | 42/7 |
| 4,862,619 | 9/1989 | Baldus et al. | 42/7 |
| 5,293,708 | 3/1994 | Strayer et al. | 42/7 |
| 5,329,718 | 7/1994 | Howard | 42/50 |

FOREIGN PATENT DOCUMENTS

| | | | |
|---|---|---|---|
| 484431 | 7/1952 | Canada | 42/50 |
| 660622 | 4/1963 | Canada | 42/7 |
| 3422334 | 12/1985 | Germany | 42/50 |
| 508134 | 6/1939 | United Kingdom | 42/50 |

*Primary Examiner*—Stephen M. Johnson
*Attorney, Agent, or Firm*—Chapin, Neal & Dempsey

[57] ABSTRACT

A magazine for a semiautomatic handgun is provided which includes a butt plate being slidably secured to the bottom thereof by side walls having slots which engage flanges on the lower edge of the magazine tube. A floor plate which serves as a seat for the magazine spring has a tang disposed on its leading edge which interfits with a slot disposed on the forward edge of the magazine tube and which serves to secure the leading edge therein. The floor plate also includes a lug which is biased by the magazine spring to interfit with a hole in the butt plate to prevent the butt plate from being slidably removed from the magazine tube.

5 Claims, 2 Drawing Sheets

20
22
23
17
18
25
27
21
49
19
24
26
28
29
32
34
30
56
52
48
35
44
53
47
41
51
50
62
60
64
40
20'
41'
21'
53'
50'
19'
b

BUTT PLATE ASSEMBLY FOR HANDGUN MAGAZINES

FIELD OF THE INVENTION

This invention relates to magazines for handguns and more particularly to a butt plate assembly for use on a magazine of semi-automatic pistols.

BACKGROUND OF THE INVENTION

In the field of semi-automatic firearms it is well known to provide a tube-type magazine which holds in vertical relationship a series of rounds of ammunition and feeds them successively upwardly to the chamber of the gun. In loading the gun, the magazine or clip is inserted upwardly into a downwardly opening chamber in the handgrip of the gun by an upward force applied to the bottom wall or butt plate of the clip. This force is typically exerted by the palm of the user's hand. The butt plate of the magazine is in many instances mounted slidably to the lower end of the tubular body for horizontal detachment therefrom for ease of assembly and disassembly for servicing, etc. A drawback associated with such slidable butt plates is that the force exerted by the user's palm during repeated insertions into the gun tends to slide the butt plate off the tubular body of the magazine.

In order to prevent such sliding, magazines have been provided with floor or latch plates which, as disclosed in U.S. Pat. No. 4,397,109, are disposed within the bottom of the magazine in engagement with the lower end of the magazine spring. Such plates include a projection or lug to releasably engage an opening provided through the butt plate to releasably retain the butt plate in fixed relation on the bottom of the magazine. A drawback to this approach is that the latch plate has a tendency to move upwardly or "submarine" into the magazine with the application of a relatively large force to the butt plate in it's "off" direction whereby the butt plate is then free to slide off the magazine tube or box. Such so called "submarining" will generally occur when the latch plate is being pushed forward by movement of the butt plate toward the forward wall of the magazine where it works its way upward alongside the spring. The result is that the butt plate is no longer latched in place by the floor or latch and is free to move relative the magazine.

Other mechanisms devised to secure slidable magazine butt plates to magazine tubes or boxes also have undesirable characteristics. For instance, the butt plate disclosed in U.S. Pat. No. 4,107,862 is slidably removable from the tube by compressing flexible side walls of the tube to allow tabs disposed thereon to clear retention lips of the butt plate. The requirement of flexible walls in such a configuration would provide a magazine having an inherent lack of structural integrity which could lead to the undesirable result of failure of the magazine in the field.

It is an object of this invention to provide an improved magazine for a semiautomatic handgun.

It is another object of this invention to provide a magazine assembly including a non-submarining floor or latch plate having means to releasably prevent sliding movement of a butt plate.

It is a further object of this invention to provide a magazine having a latch and butt plate assembly which overcomes the drawbacks of magazine butt plate devices heretofore available.

A further object of this invention is to provide a magazine assembly that is lightweight and relatively inexpensive to manufacture while being reliable in operation.

Another object of this invention is to provide a magazine assembly which is easier to assemble than prior art devices while providing a high degree of structural integrity.

Yet a further object of this invention is to provide a simple and effective magazine and butt plate construction so that different length magazine tubes can be accommodated in the same gun without the likelihood the wrong butt plate being improperly used on the wrong size magazine.

According to this invention, a magazine has a lower end closure that includes a floor plate disposed within the lower end of the magazine and includes a lug which interengages with an opening in a butt plate. A tongue is provided on the leading edge of the closure which is adapted to interengage with a notch in the lower edge of the magazine. This arrangement serves to retain the leading edge of the closure plate in place within the magazine tube while permitting the closure plate to be pivoted sufficiently against the bias of the magazine spring when the lug to be depressed to clear the opening of the butt plate for the installation and removal of the butt plate.

The above and other objects and advantages of this invention will be more readily apparent from a reading of the following description of an exemplary embodiment thereof taken in conjunction with the following drawing.

DETAILED DESCRIPTION OF THE PREFERRED EMBODIMENT

Figure 1B:
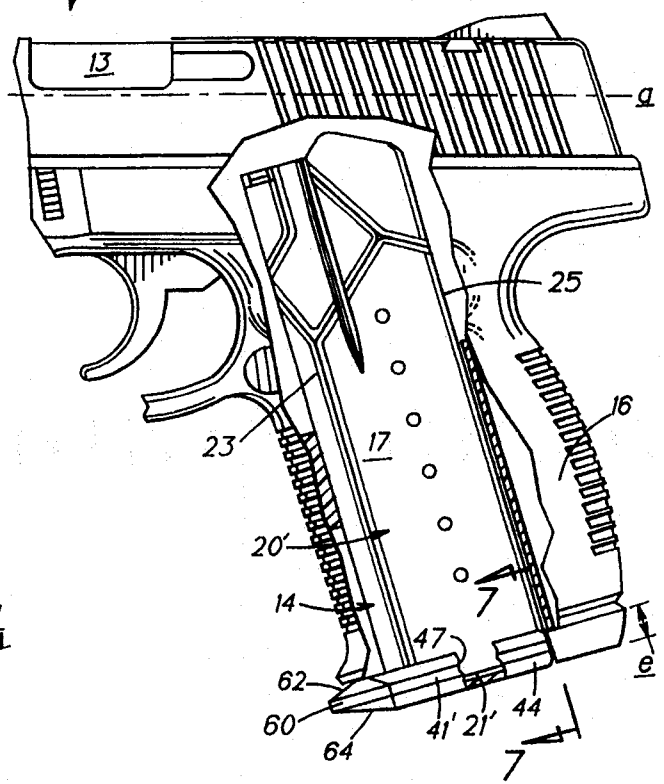
FIGS. 1A and 1B are elevational views of a handgun, shown partially in section and which magazines are fitted with butt plates of the present invention.
Figure 1A:
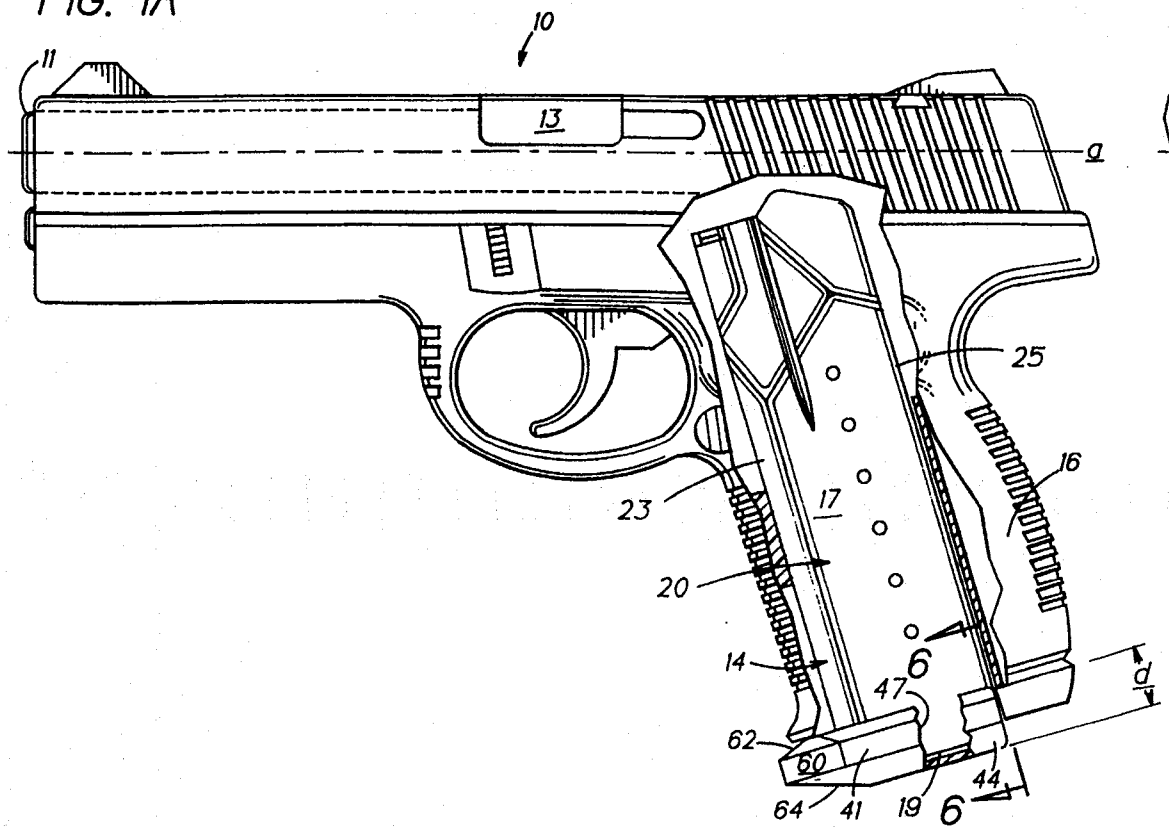

Referring to FIGS. 1A and 1B, a semiautomatic handgun 10 of the type which incorporates the present invention includes a barrel 11, a chamber 13 and a box or tubular type magazine 20 and 20' which is received within a downwardly opening chamber or cavity 14 disposed within the handgrip portion 16 of the handgun. The magazine is insertable upwardly into the cavity 14 to the position as shown in FIG. 1 and is removable downwardly from the recess for reloading. One feature of this invention is that two different length magazines 20 and 20', the former for holding 15–16 rounds and the latter 14–15 rounds, depending upon the caliber of the ammunition, will be available to fit within the magazine chamber 14 of the gun 10. As will hereinafter be more fully described, different putt plates 41 and 41' are provided to fit selectively on the magazine tube 20 and tube 20' respectively.

Figures 2, 3, 4, 5, 6, 7:
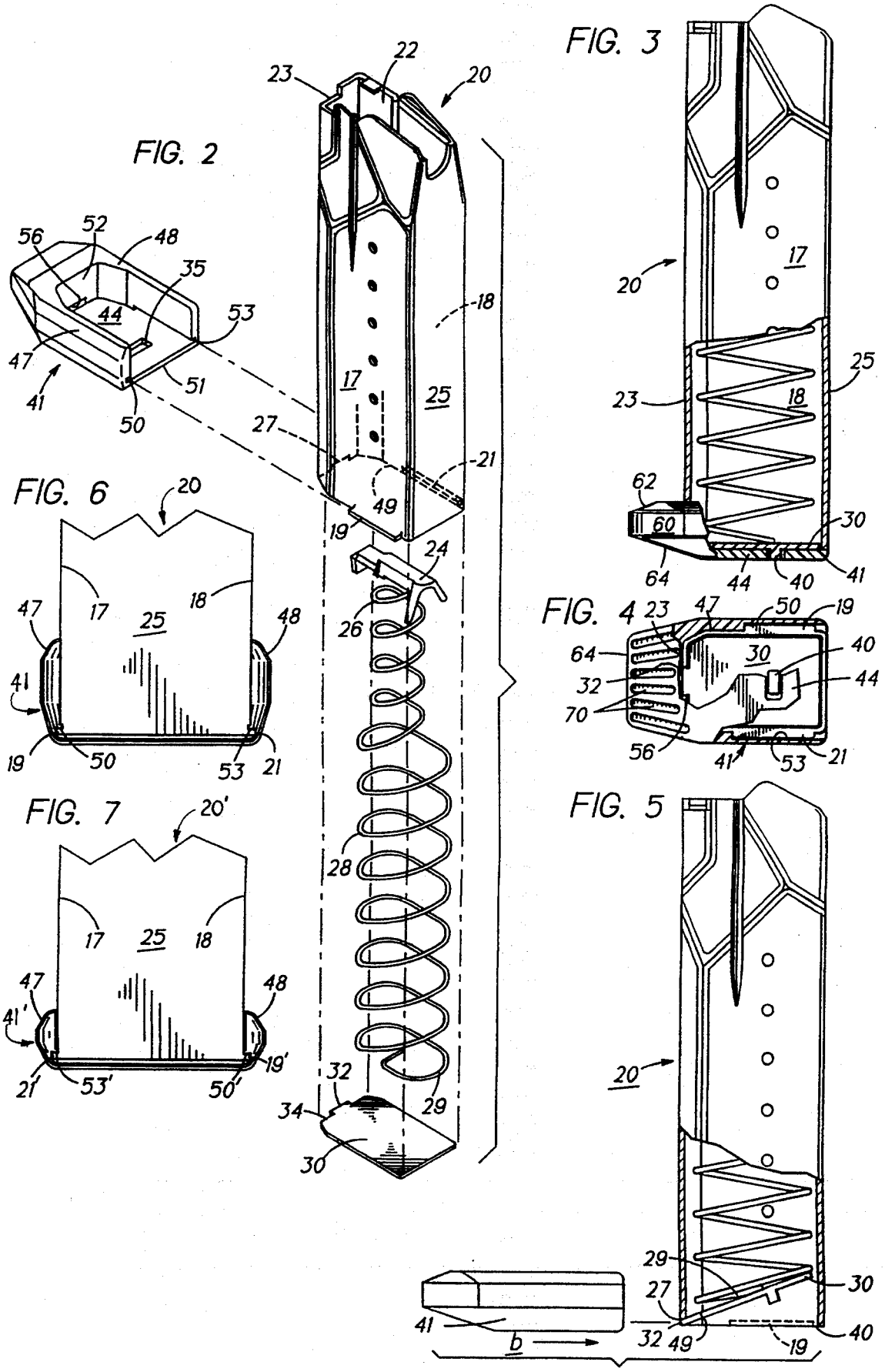
FIG. 2 is an exploded perspective view of the magazine and butt plate of FIG. 1.
FIG. 3 is a cross-sectioned elevational view partly in section of the fully assembled magazine of FIG. 2.
FIG. 4 is a bottom plan view of the butt plate and magazine of FIG. 2 partly in section.
FIG. 5 is all elevational view of the magazine of FIG. 4 partly in section of a step in the assembly thereof.
FIG. 6 is an sectional view taken along line 6—6 of FIG. 1A.
FIG. 7 is a sectional view taken along line 7—7 of FIG. 1B.

Referring now to FIG. 2, both magazines include a rigid elongated tubular member 20 or 20' of generally rectangular cross-section each having left and right side walls 17 and 18 respectively, front and rear walls 23 and 25 respectively, and an open upper end 22. As mentioned above, the magazine tubes 20 and 20' are each adapted to receive and hold a different number of rounds of ammunition (not shown) in parallel relation in a conventional manner. As will best be seen in FIG. 2, flanges 19 and 21 are of different length and extend laterally outward from the lower edges of the left and right side walls 17 and 18, respectively, of the magazine tube 20. The flange 19 is substantially shorter than the flange 21 and as shown in FIG. 1A, the longer magazine 20 has a short flange 19 and is on the left side wall and the longer flange 21 on the right side wall 18 whereas in the shorter magazine 20', also depicted in FIG. 1B, the positions of the flanges are reversed or on the opposite sides so that the longer flange 21' is disposed on the left side of the magazine and the flange 19' is on the right side thereof. The front wall 23 of both magazines has a downwardly opening notch 27 disposed at its bottom edge which is adapted to receive a tongue or tang 32 that extends outwardly of the leading edge 34 of a latch or floor plate 30.

On the longer magazine 20, the flanges 19 and 21 are adapted for selective mating only with butt plate 41 which, as will be seen at d in FIG. 1A, is substantially deeper in the vertical direction than butt plate 41' which, as shown at e in FIG. 1B, is adapted to fit on only the shorter magazine tube 20'. It will be evident that in the butt plate 41 that the shorter groove 50 and the longer groove 53, as shown in FIGS. 2 and 4, are respectively on the left and right sides of the butt plate 41. On the lower profile butt plate 41', however, the grooves are disposed on the opposite sides thereof. The unequal length flanges 19' and 21' as well as grooves 50' and 53' are therefore mirror images of flanges 19 and 21 and grooves 50 and 53 to effectively prevent improper assembly of the "compact" or "shorter" butt plate 41' onto the "longer" tube 20 or the deeper butt plate 41 onto the shorter tube 20'. With this arrangement, only the deeper profile butt plate 41 will fit onto the longer magazine tube 20 while only the lower profile butt plate 41' will only fit on the shorter magazine 20'. As a result, in assembling the two different magazines, one can only assemble them with the properly sized butt plate which will ensure that each magazine 20 and 20' will extend into the magazine chamber 14, the same distance for proper engagement with the magazine latch (not shown).

Other than the size and the selective mounting arrangement of the butt plates, the two magazines are virtually identical and as will be noted in FIGS. 2–5, both magazines will hereinafter referred to as 20. Each magazine includes a follower 24 for engagement with the lowermost of stack cartridges, is disposed at the upper end 26 of a magazine spring 28 that yieldingly urges the follower upwardly thereby to feed the cartridges successively toward the open upper end 22 of the magazine tube and from where that round will be picked tip by the bolt and moved into the chamber of the gun 10. The lower end 29 of the spring 28 is seated against the tipper surface of a latching member or floor plate 30 which has the tongue or tang 32 that protrudes from a leading edge 34 thereof for fitting into the notch 27 of the magazine tube. As shown in FIG. 4, a lug 40 is disposed on the opposite side or outer surface of the floor plate 30 and is adapted to fit through an opening 35 in the planar portion 44 of either butt plate, hereinafter referred to as 41.

As shown in FIGS. 2 and 4, the butt plate 41 includes an end wall 52 and side walls 47 and 48 which extend upwardly at right angles from its planar base portion 44 generally along the three (3) sides of the perimeter of the planar portion. At the lower edges of the side walls 47 and 48 are longitudinally extending grooves 50 and 53 respectively, are provided for slidably receiving the left and right hand flanges 19 and 21 of magazine tube 20 to retain the butt plate thereon, as best shown in FIGS. 1A, 2 and 6. The grooves 50 and 53 do not extend the entire length of the walls 47 and 48, respectively, but are only long enough to accommodate their respective flanges 19 and 21 which will permit the butt plate 41 to slide fully onto the magazine tube 20, as shown in FIG. 1A. A recess 56 is also provided in the end wall 52 at the junction of the wall and the planar portion 44 thereof, into which the tang 32 of the floor plate 30 protrudes when the butt plate is fully assembled, as shown in FIG. 4.

Referring now to FIGS. 1A and 1B, the butt plate 41 and 41' each comprises a nose portion 60 having generally converging upper and lower surfaces 62 and 64, respectively. The upper surface is contoured to serve as an extension of the lower portion of the grip 16 of the handgun 10 to provide some support for the lower edge of the small finger of the shooting hand. The lower surface 64 is generally planar and disposed at all oblique angle relative to the planar portion 44 of the butt plate 41 so when the magazine 20 or 20' is inserted into the chamber 14 in the handgrip of the gun, the angled surface 64 will be parallel to the axis a of the barrel 11 of the handgun 10. This characteristic allows the user to rest the handgun on a level surface to aid in holding the gun steady and level during firing thereof. As best shown in FIG. 4, the angled surface 64 may include a plurality of cutouts or slots 70 which reduces the amount of the material required for the molding of the butt plates and also provides a roughened outer surface for better positional stability when used for aiming the gun.

The assembly of either length of the magazine tube comprises the same steps to both embodiments. As best shown in FIG. 2, the follower 24 on the upper end 26 of the spring 28 is inserted into the tube 20 through the open lower end 49 thereof. The floor plate 30 is then placed on the lower end 29 of the spring which is compressed until the tang 32 fits into the notch 27 of the tube 20. While holding the floor plate 30 in this position, the butt plate 41 is slid in direction b, as shown in FIG. 5, onto the lower edge of the tube with the grooves 50 and 53 in engagement with the flanges 19 and 21, as shown in FIG. 4. The butt plate can be slidably moved in this manner until the leading edge 51 (FIG. 2) of the planar portion 44 has moved past the lug 40 at which time the user can release the plate 30 whereby the spring 28 will bias the latch 30 against the planar portion 44 of the butt plate. From this position, the butt plate 41 can be slid further onto the tube until the inner ends of the flanges and grooves come into contact. At substantially the same time, the wall 52 of the butt plate will be brought into surface-to-surface engagement with the wall 23 of the tube at which time the tang 32 of the plate 30 will extend into the recess 56 of the wall 52, as shown in FIG. 4. Also, the hole 35 (FIG. 2) in the planar portion 44 will be vertically aligned with the lug 40 and the lug will be moved outwardly by the spring 28 to fit within the hole 35 to lock the butt plate on the lower end of the magazine tube 20.

The butt plate 41 can be removed by depressing the lug 40 inwardly compressing the spring 28 sufficiently to enable the underside of the planar portion 44 of the butt plate to clear the lug 40, enabling the butt plate to be slid off the lower end of the magazine. The construction of this invention provides for quick and simple assembly thereof while the lug 40 prevents the butt plate from sliding off the flanges of the magazine tube unintentionally. Further engagement of the tang 32 of the floor plate 30 within the notch 27 of the wall 23 of the tube effectively secures the floor plate in fixed position within the lower end of the magazine tube.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. A magazine for a semi-automatic firearm having a barrel and comprising a tube having an upper and a lower end, a spring longitudinally disposed within the tube, a floor plate disposed at the lower end of the tube and having a tang on an edge thereof which interengages with a notch in a lower edge of the tube whereby said edge of said floor plate is disposed in fixed relation to the tube while said floor plate is pivotable against the bias of the spring and a butt plate slidably disposed onto the lower end of the tube to retain and be retained in superimposed relationship therewith, said floor plate having a lug which interfits into an opening in the butt plate to latch the butt plate in place on the magazine while permitting removal thereof by depressing the lug to clear the opening of the butt plate.

2. The magazine of claim 1, wherein the butt plate further comprises a lower planar surface disposed in parallel relation to an axis of the barrel whereby a user can support the firearm with the barrel maintained in level orientation by placing said surface on a level object.

3. The magazine of claim 1, in which said butt plate further comprises grooves on opposite sides thereof which interfit with corresponding flanges in side walls of said magazine tube.

4. The magazine of claim 3, in which said grooves are of unequal length and correspond with said flanges of similar unequal length.

5. A magazine for semi-automatic firearms having a barrel and being capable of receiving at least two magazine tubes of different length, each tube comprising an upper end and a lower end, a spring longitudinally disposed within the tube, a floor plate disposed at the lower end of the tube and having a tang on an edge thereof which interengages with a notch in a lower edge of the tube whereby said edge of said floor plate is retained in fixed relation to the tube, with said floor plate being pivotable against the bias of the spring and at least two butt plates, one for each of said magazine tubes, one of the butt plates having side walls of a given depth and the other having side walls of depth shallower than said given depth, each said plate being adapted to fit respectively with longer and shorter of said magazine tubes, each of said tubes having flanges of unequal length on opposite lower side edges thereof and in which the flanges on one of said magazines are disposed on opposite sides from the flanges of the other said magazines, and the butt plate of said given depth having grooves of unequal length on opposite sides thereof adapted to interfit only with the flanges on the longer of said magazine tubes and the shallow depth butt plate having grooves adapted to interfit only with the flanges on the shorter of said magazine tubes so that each said butt plates can only be assembled on the magazine tube of proper length.

* * * * *